United States Patent [19]

Branz et al.

[11] Patent Number: 4,949,554

[45] Date of Patent: Aug. 21, 1990

[54] SINGLE PANE, CURVED GLASS LID, FROZEN FOOD MERCHANDISER

[75] Inventors: Michael A. Branz; Ralph A. Fuhrmann, Jr., both of Spartanburg, S.C.

[73] Assignee: Specialty Equipment Companies, Inc., Berkeley, Ill.

[21] Appl. No.: 404,780

[22] Filed: Sep. 8, 1989

[51] Int. Cl.[5] ..... A47F 3/04

[52] U.S. Cl. ..... 62/248; 62/298

[58] Field of Search ..... 62/248, 298, 246; 312/116

[56] References Cited

U.S. PATENT DOCUMENTS

| | | | |
|---|---|---|---|
| 2,672,735 | 3/1954 | Fusselman | 62/248 |
| 2,911,799 | 11/1959 | Guyton et al. | 62/248 |
| 3,712,078 | 1/1973 | Maynard et al. | 62/298 X |

*Primary Examiner*—William E. Tapolcai

*Attorney, Agent, or Firm*—Dority & Manning

[57] ABSTRACT

A frozen merchandiser has a plurality of single pane, cylindrically curved, glass lids which are slidably counterbalanced with springs. Front and back plastic extrusions block the passaage of air, and the front extrusion provides a mounting surface for a handle. A refrigerated compartment has a fin-and-tube evaporator disposed in the upper portion thereof and against the rear wall thereof. The compartment has an access opening that is defined by a free edge of the front wall of the compartment and is disposed at a relatively low height above the floor on which the merchandiser rests. The mechanical components of the refrigeration system are mounted on a board that is slidable into and out of a housing which is heat insulated from the refrigerated compartment. The tubes carrying the refrigerant are disposed around and against the exterior of the compartment walls and held thereagainst by foamed heat insulation that surrounds the walls of the refrigerated compartment. A fan moves air across the compressor and condenser and up through a channel disposed in front of the compartment front wall and between the front wall and the cabinet. The channel has an exit slot defined by the free edge of a front edge member that is configured to direct air exiting the slot to attach to the exterior surface of each of the curved glass lids when they are enclosing any portion of the compartment access opening. The free edge of the front edge member is disposed at a relatively low height from the floor on which the merchandiser rests.

20 Claims, 4 Drawing Sheets

SINGLE PANE, CURVED GLASS LID, FROZEN FOOD MERCHANDISER

BACKGROUND OF THE INVENTION

The present invention relates to frozen food merchandisers and more particularly to a low-height access, continuously defogged, single pane curved glass lid, frozen food merchandiser.

Food storage equipment has become a tool in the marketing or merchandising of food. Thus, food storage equipment emphasizes display of the food to the customer For example, U.S. Pat. No. 3,729,243 to Musgrave et al discloses an ice cream dipping cabinet having a window means and a vertically sliding, cylindrically curved, transparent lid that closes the upper front and forward top of the cabinet. The server accesses the cabinet from the top, and the window means and transparent lid permit both the customer and the server to view the merchandise in the cabinet with the lid open or closed.

Increasing labor costs, among other factors, have prompted food retailers to use food storage equipment that permits the customers to serve themselves rather than requiring store personnel to remove the food from the storage equipment. For example, a refrigerated display cabinet such as shown in U.S. Pat. No. 3,759,059 to Kenyon has a stationary, multi-pane, transparent front wall 23 and two slidable transparent covers 31 and 32. The covers are planer and slide from front to back. An evaporator 18 is supported in the upper refrigerated compartment 11 and rests against the rear wall of compartment 11 near the upper portion of compartment 11. A lower nonrefrigerated compartment 12 houses a compressor 31 shown as a sealed unit and a condenser 32. The condenser is mounted towards the front of lower compartment 12, and the compressor 31 is disposed near the rear of lower compartment 12. A blower 33 is disposed between condenser 32 and compressor 31 in lower compartment 12 and draws air over condenser 32 through a screen 42 which is at a relatively high level above the floor in front panel 36. An opening 45 is disposed near the "toe space" beneath the front panel near the adjacent floor. An opening 52 is provided in the rear wall of the cabinet. Air drawn into the lower compartment through screen 42 by blower 33 exits opening 45 and opening 52 after passing across condenser 32 and compressor 31.

Various designs have addressed the prevention and/or removal of condensation forming on various surfaces of refrigeration equipment. Preventing or removing such condensation has been addressed. For example, U.S. Pat. No. 4,009,586 to Skvarenina discloses a conventional metal door refrigerator/freezer with various devices for removing or eliminating the formation of moisture from accumulating along the exterior edge of a door or along the exterior housing of a refrigerator or freezer immediately adjacent the sealed edge of the door. These are conventional refrigerator/freezer units having either side-by-side vertically disposed doors or a separate horizontal freezer door above or below the refrigerator door. A motorized refrigerating component 14 such as a sealed motor compressor unit is disposed at the lower portion of a housing 11 and is cooled by either convection to the air surrounding the compressor unit 14 or by a cooling fan blade 16. The warmed air produced by the compressor is directed through a vent 18 located at the bottom portion of housing 11. Vent 18 extends substantially the entire width of the freezer door 12 and provides a rising column of air along the vertical edges of the door. A duct 22 may be provided to direct warm air from compressor 14 to vent 18.

One problem that occurs with frozen food merchandisers is the tendency of the transparent viewing surface to fog with condensation forming thereon. The DIPLOMAT LINE brand bulk ice cream merchandisers produced by Universal/Nolin, a division of UMC Industries, Inc. of Conway, Ark., employs a full-width glass service counter and a curved glass lid. The lid moves from front to back and extends across the full width of the merchandiser. The opening to the interior of the merchandiser begins at a height of about 3 feet from the floor on which the merchandiser sits. The entire cabinet is encased in urethane, foamed-in-place insulation. It has a bare-tube condenser that can be pulled out from its housing. However, the DIPLOMAT LINE equipment is recommended for draft-free locations in air-conditioned stores as it lacks any means to prevent the transparent surfaces from becoming fogged with condensation.

The problem of fogging viewing surfaces has been addressed in a number of ways, including the establishment of a flow of warm air over the glass panels. The relative effectiveness of designs for establishing this flow of warm air depends upon various factors such as whether the transparent surface is stationary or forms part of a door or cover giving access to the interior of the refrigerated space. Other factors involve whether the viewing surface has a single pane or is a multi-pane surface. Still other factors pertain to the shape of the transparent surface, the location of the transparent surface relative to other surfaces, and the manner in which the transparent surface may be moved or manipulated by the customer. For example, in U.S. Pat. No. 2,438,972 to Hoffman, a refrigerated display case has a door comprising an outer surface formed by a pane of cylindrically curved glass and an inner surface formed by multiple panes of glass. The door is pivotally mounted to swing upwardly and toward the rear of the display case. A light having an electrical ballast is disposed in the space between the curved outer pane and the multiple inner facing panes. The electrical ballast generates heat to raise the temperature of the air in the space sufficiently to prevent fogging of the cylindrically curved outer glass pane. The multiple glass panes prevent transfer of the heat from the space inward through the door into the refrigerated space.

U.S. Pat. No. 3,462,966 to Reid et al (assigned to the assignee of the present application) discloses a way of removing condensation forming on the inner surface of a glass panel of a refrigerator door when the door is opened. This refrigerated cabinet establishes an air curtain in front of its opening to prevent entry of warm air into the refrigerated space when patrons are opening its glass panel doors to make a selection. The warm air curtain also prevents condensation on the door panels when they are closed after the patron has removed an item from the cabinet. The refrigerated cabinet has a pair of door panels with glass panels 34 mounted in a tubular frame 32 around the perimeter thereof. The door panels are hingedly mounted on the front edge portion 14 of the cabinet. A condenser coil assembly 54 is mounted within a non-refrigerated space below the refrigerated space and insulated therefrom. A blower is also mounted within the non-refrigerated space rearwardly of the condenser coil. Centrally mounted within the non-refrigerated space at the forward end is an air scoop device provided with a dimensionally enlarged inlet end aligned with the condenser coil assembly and close thereto to converge forwardly from the inlet to an outlet end positioned just below the forward edge portion of the wall 28 which partitions the refrigerated space from the non-refrigerated space. The air flow is induced to pass between the coils of the condenser coil assembly for heat exchange purposes that results in the discharge of heated air through a front grill 16 which extends horizontally across the lower front portion of the cabinet and is removably mounted thereon. A deflecting portion 96 of the grill work behind a front grill 16 cooperates with a scoop device 78 and duct forming members 98 to laterally distribute the air flowing upwardly from the opening. The front grill discharges warm air vertically in an upward direction to form a warm air curtain in front of the access opening closed by the door panels. The access opening to the refrigerated space is formed in a plane with which the front edge portions of the cabinet walls are aligned. Magnetic strips within peripheral sealing elements or strips are mounted on the tubular frame of each door panel for contact with the forward edge portions of the side walls, the partition wall 28 separating the refrigerated cabinet from the non-refrigerated cabinet, and the top wall. The magnetic strips cooperate with the magnetic inserts to hold the door panels closed. The door panels are disposed externally of the cabinet rather than being recessed in the edge portions of the cabinet walls as in prior constructions. This prevents the door panels from being directly exposed to the cold zone of the refrigerated space. The door panels also extend downwardly beyond the refrigerated space and overlap the front edge portion of the wall 28 which separates the refrigerated space from the non-refrigerated space. Thus, the air rising from the front grill immediately contacts the tubular frames of the door panel assemblies. When the door panel assemblies are opened, the upward air flow forms an air curtain or barrier between the atmosphere and the refrigerated space, this air curtain being more effective in defogging the door panels because of the panel mounting externally of the cabinet.

Hanson et al (U.S. Pat. No. 2,542,136) discloses a frozen food display cabinet having a flat front window disposed at an angle relative to vertical and having non-transparent top doors to provide access to the display chamber. The window has multiple spaced-apart panes and does not open to provide access to the display chamber. A compressor is disposed within a chamber located beneath the display chamber and insulated therefrom. The compressor chamber also houses a refrigerating coil connected to the compressor. A circulation fan is connected for direct communication with the housing containing the condenser or radiating coil as it is referred to in Hanson et al. Air from the chamber housing the compressor and condenser is directed upwardly from a discharge head that is arranged at the lower edge of the outside pane of the diagonally disposed flat window and connected to the fan housing by a duct.

Aoki (U.S. Pat. No. 4,741,172) discloses a refrigerated display cabinet in which warm air from the chamber 21 housing the compressor 211 and condenser 212 is directed from above onto the flat horizontal surface of a horizontally side-to-side sliding, single pane, smoothly turning right-angle-shaped, glass door to prevent condensation thereon.

Wallace et al (U.S. Pat. No. 4,750,335) discloses a refrigerated glass front display case with a display window 28 hinged at the top end and formed of a single panel with a generally concave surface facing the refrigerated compartment 37. The cross section of the side edge of the window is shaped like the top three sides of a trapezoid. The lower end of the display window includes a viewing surface that is almost vertical. The upper end of the display window includes a viewing surface which is almost horizontal and defines part of the top of the refrigerated case. A diagonally disposed viewing surface is intermediate the upper and lower ends of the display window. An electric heating element 64 is disposed in a secondary air passage 62 to direct the flow of a warm air curtain that prevents fully refrigerated primary air from impinging against the inner surface of the display window. The entire inner surface of the window, within the case, is in contact with the secondary air curtain, and as a result, the formation of condensate is completely eliminated or in any event reduced to an acceptable level. A circulating fan 40 blows the refrigerated air toward a vertically disposed front passage that has a vertical divider or separator panel 58 formed of heat insulation material to define primary 60 and secondary 62 air passages having parallel outlet openings 63, 65. Since some of the refrigerated air must be heated by a separate heating element, this is not an efficient arrangement. Having warmed air inside the refrigerated space also reduces the efficiency of the refrigeration.

Frozen foods have become a significant portion of the stock of food carried by retail stores, perhaps reflecting changing lifestyles that demand food products which can be prepared within a short time. The frozen food sections of food retailers have been expanded, and the equipment used to store and merchandise such food takes up a larger portion of the floor space of such food retailers. Customer access to the refrigerated compartments of the food storage equipment and the large number of such pieces of equipment in a retail store require the equipment to be energy efficient.

U.S. Pat. No. 2,534,488 to Weber discloses a refrigerated structure with three curved transparent closure members and serially connected refrigerant tubes disposed round the interior of the refrigerated cabinet. Insulating material is interposed between an interior sheet metal wall and an exterior shell. The series of pipes carrying refrigerant are mounted practically in abutment with the interior wall.

Swanson (U.S. Pat. No. 2,706,387) discloses a refrigerator cabinet of the open top "reach in" type having an evaporator 7 disposed in a cooling chamber 6 located beneath the refrigerated compartment 2. A multiple glass wall 11 is disposed in front of a front panel 10 of the refrigerated compartment to form a transparent insulated front of the upper part of the cabinet. The front panel 10 of the refrigerated cabinet also may be of glass for transparency. A front chamber 15 in the lower part of the cabinet houses a compressor 12, a condenser 13, and a fan 21 between the compressor and condenser. A passage 18 has a lower end communicating with the front chamber 15 and an upper end joins another chamber 19 which extends substantially the full width of the cabinet and has an upper wall which terminates a short distance from the front or outer side of the transparent wall 11 to form an elongated narrow outlet passage 20 adjacent the transparent wall 11. A part of the condenser can be located in this other passage 19. Fins can radiate from this part of the condenser in chamber 19 and be located against the front plate 17 of the cabinet so that heat thrown off from the refrigerant in the tubes forming this other part of the condenser will be more efficiently conducted to the front of the cabinet. Heat from the front chamber 15 flows into the other chamber and out through the passage against the outer surface of the upper transparent wall. Thus, the Swanson device uses heat emitted from the condenser and the compressor to warm the front exterior surface of the cabinet so that moisture of condensation will not form thereon and to flow upward into chamber 19 and out through passage 20 against the outer glass pane of the multiple pane, upper transparent wall 11.

Self-service food storage equipment should facilitate customer access to the food once a selection has been made by the customer. Because various marketing techniques are directed at both children and adults, the compartment where the food is stored must be accessible, both visually and within reach, to children as well as adults. While the Wallace et al display case has a relatively low-height access, it suffers from energy deficiencies noted above. Moreover, the Wallace et al door is not designed for ease of handling by customers, who would be unschooled in its use.

OBJECTS AND SUMMARY OF THE INVENTION

It is a principal object of the present invention to provide a single pane, curved glass lid frozen food merchandiser of an energy efficient design that prevents fogging of the curved glass lid and permits easy customer access to both adult and child customers to easily view and remove the merchandise.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the frozen food merchandiser comprises a compartment for holding items to be frozen. The compartment defines a rear wall, a top wall, a pair of end walls, a front wall, a lower bottom wall, an upper bottom wall disposed closer to the top wall than is the lower bottom wall, at least one interior side wall that connects one end of the lower bottom wall to one end of the upper bottom wall, and at least one compartment access opening. The compartment access opening preferably is defined at least in part by a free edge of the front wall and a free edge of the top wall. The merchandiser further includes a housing that defines a top panel, a rear panel, two opposed side panels, and a front opening. A compressor and a condenser are mounted within the housing with the condenser disposed preferably closest to the front opening of the housing.

In further accordance with the present invention, means are provided for moving air across the condenser and the compressor and out of the housing. As embodied herein and shown in FIGS. 1 and 2. by way of example, the means for moving air across the condenser and the compressor and out of the housing preferably includes a fan 64, which is disposed preferably between condenser 60 and compressor 58 and driven by a motor 62.

The mechanical components of the refrigeration system are preferably slidably mounted on a mounting board to move into and out of the housing through the front opening thereof. The housing and the compartment are enclosed by a cabinet.

In further accordance with the present invention, means are provided for allowing selective access to the compartment. As embodied herein and shown in FIG. 4 by way of example, the means for allowing selective access to the compartment includes at least one, single pane, curved glass lid 70. Preferably, a plurality of single pane, cylindrically curved glass lids are used to enclose the compartment access openings. Each side edge of each glass pane is slidably mounted on curved tracks which are disposed across each compartment access opening and between the compartment top wall and the cabinet. The back edge of each glass pane is attached to a T-shaped dual durometer extrusion, and the front edge of each glass pane is attached to an H-shaped dual durometer extrusion, on which is mounted a handle.

In further accordance with the present invention, means are provided for transferring warmed air from the housing onto the selective access means to continuously defog the selective access means. As embodied herein and shown in FIGS. 1 and 2. by way of example, the means for transferring warmed air from the housing onto the selective access means to continuously defog the selective access means preferably includes an elongated channel 82, which is disposed in front of compartment front wall 20 and defined between front wall 20 and cabinet wall 56. Preferably, a dividing wall 84 is disposed between compartment front wall 20 and cabinet 56 to cooperate with cabinet 56 to define channel 82 therebetween. The channel extends substantially the full length of the extent of the curved glass lids along the front of the merchandiser. The channel communicates with the housing via the front opening of same and receives warmed air exiting through the front opening of the housing. At an upper end of the channel, there is an exit slot defined by a front edge member having a free edge disposed above a free edge of the compartment front wall. Preferably, the free edge of the exit slot is disposed at a height of less than 26 inches above the floor on which the merchandiser rests. The front edge member extends along substantially the full length of the extent of the curved glass lids along the front of the merchandiser and is configured and disposed to direct air exiting the slot to attach to the exterior surface of each of the curved glass lids when the lids are enclosing any portion of the compartment access opening.

A shelf preferably extends from the rear wall of the compartment and within same and is disposed closer to the top wall of the compartment than to the bottom wall of the compartment. An evaporator preferably is disposed above the shelf and extends across substantially the full length of the compartment. The evaporator preferably is mounted against the rear wall of the compartment in the upper portion thereof closer to the top wall than to one of the bottom walls of the compartment. The refrigerant is carried between the evaporator and the compressor and condenser by at least one conduit having a plurality of lengths disposed at various angles with respect to one another so as to surround and rest against various of the exterior surfaces of the walls of the compartment and serve as a cold wall evaporator.

Foam insulation preferably is disposed around the refrigerant conduit and the exterior surfaces of the walls of the compartment and between such walls and the various other structures enclosing the compartment. These other structures include the cabinet, the dividing wall that forms one of the walls of the channel, and various of the panels forming the housing. The insulation expands and helps secure the conduit to the compartment walls as well as reinforcing the compartment walls.

The accompanying drawings, which are incorporated in and constitute a part of this specification, illustrate one preferred embodiment of the invention and, together with the description, serve to explain the principles of the invention.

DETAILED DESCRIPTION OF THE PREFERRED EMBODIMENT

Reference now will be made in detail to the present preferred embodiments of the present invention, one example of which is illustrated in the accompanying drawings. This example is provided by way of explanation of the invention, not limitation of the invention. In fact, it will be apparent to those skilled in the art that various modifications and variations can be made in the present invention without departing from the scope or spirit of the invention. Thus, it is intended that the present invention cover the modifications and variations of this invention provided they come within the scope of the appended claims and their equivalents.

Figure 1:
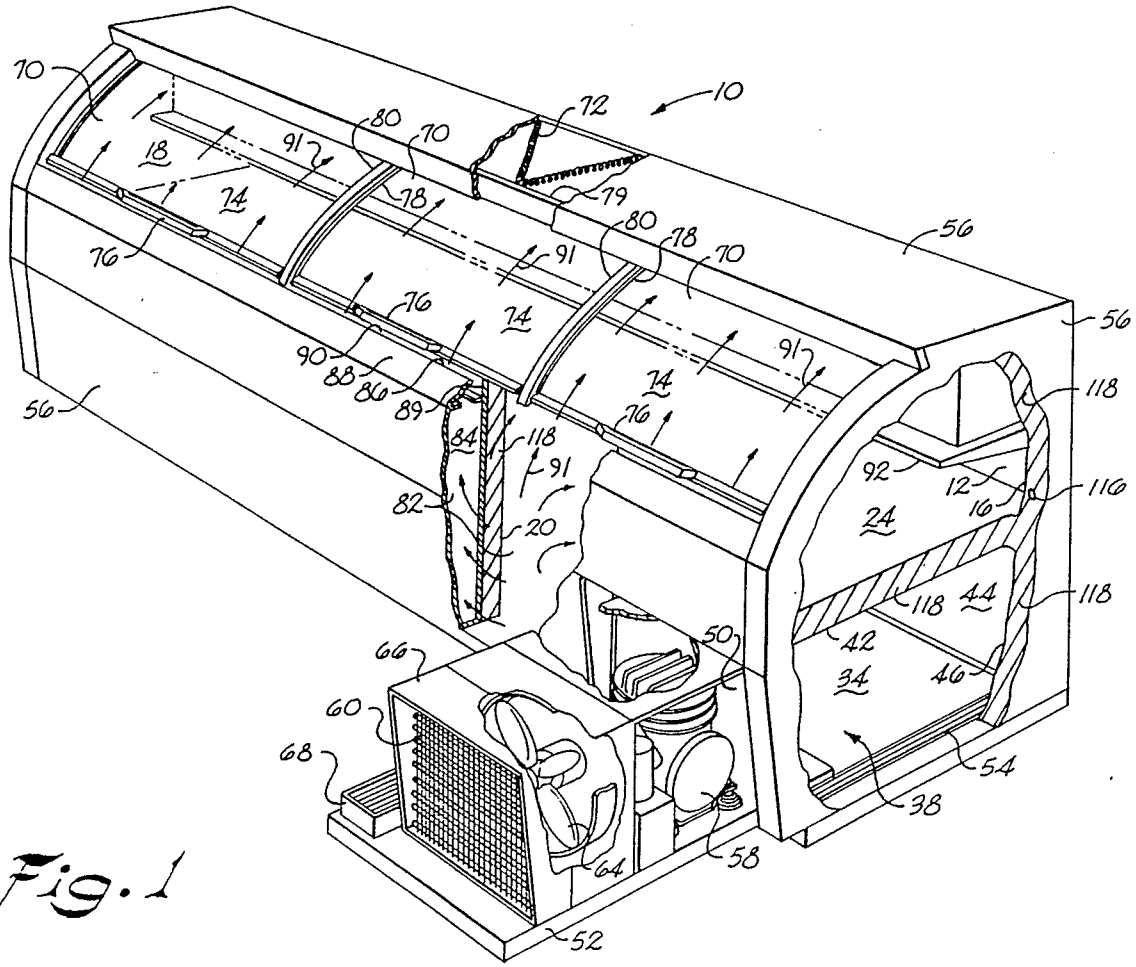
FIG. 1 shows a perspective view of a preferred embodiment of the present invention with portions cut away to facilitate illustrations of various features of the embodiment.
Figure 2:
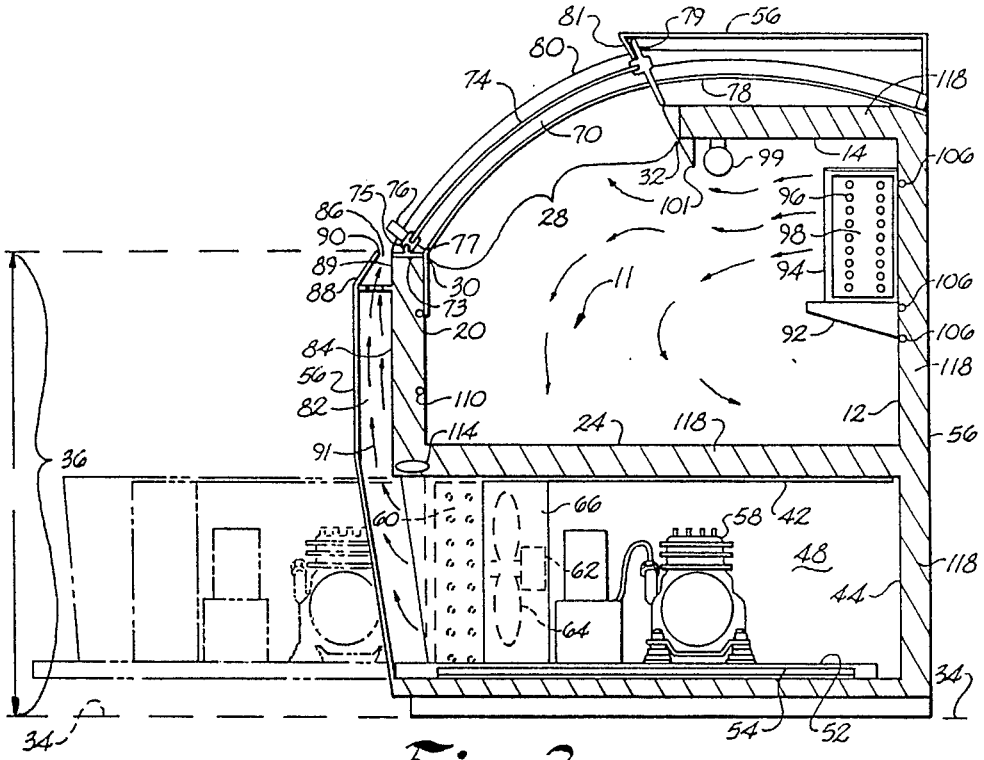
FIG. 2 illustrates a side cross-sectional view of a preferred embodiment of the present invention with an alternative disposition of certain components illustrated in dashed lines.
Figure 3:
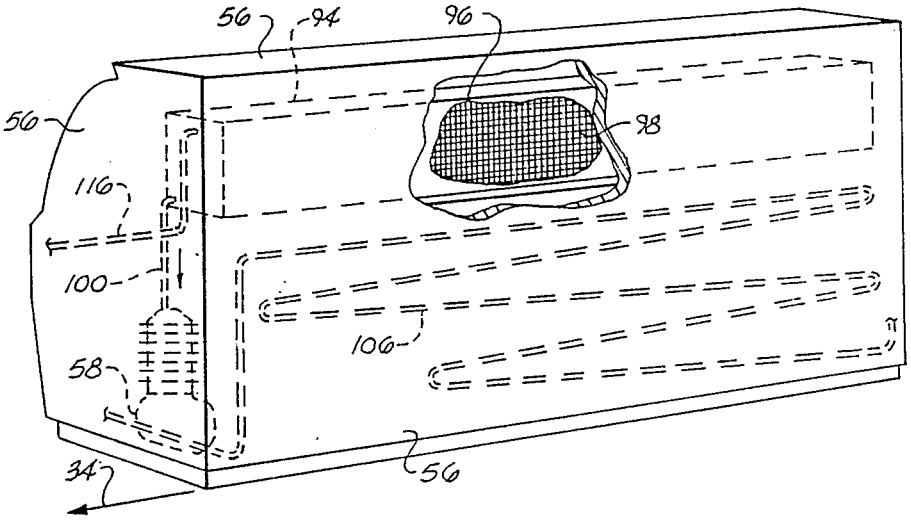
FIG. 3 illustrates a perspective view of a preferred embodiment of the present invention taken from the rear and schematically illustrating in dashed lines the relative positioning of the evaporator, the compressor, and the tubes carrying refrigerant from the compressor to the evaporator and returning same toward the condenser (not shown) and a cut away of the evaporator showing the internal fins and tubing.

A preferred embodiment of the frozen food merchandiser of the present invention is shown in FIG. 1 and is represented generally by the numeral 10. In accordance with the present invention, a compartment is provided for holding items that are intended to be frozen. The compartment is refrigerated as will be described below. As embodied herein and shown FIGS. 2 and 5 for example, a compartment 11 defines a rear wall 12, a top wall 14 (not shown in FIG. 5), a pair of end walls 16, 18 (not shown in FIG. 2), a front wall 20, a lower bottom wall 22 (not shown in FIG. 2), an upper bottom wall 24, at least one interior side wall 26 (not shown in FIG. 2), and at least one compartment access opening 28 (not shown in FIG. 5). As shown in FIG. 2 for example, upper bottom wall 24 is disposed closer to top wall 14 than is lower bottom wall 22 (not shown in FIG. 2 but shown in FIG. 5). Interior side wall 26 extends between and connects one end of lower bottom wall 22 and one end of upper bottom wall 24. As shown in FIG. 2 for example, at least one compartment access opening 28, and preferably each said compartment access opening 28, is defined at least in part by a free edge 30 of front wall 20 and a free edge 32 of top wall 14. The various compartment walls are preferably formed of thin gauge tin or aluminum or another heat conducting metal material.

In further accordance with the present invention, preferably, free edge 30 of front wall 20 is disposed to extend up to a height of no greater than 26 inches above the floor level 34 on which the merchandiser rests. As shown in FIG. 2, a measurement has been designated by the designating numeral 36 to indicate the height between free edge 30 of front wall 20 above floor level 34. This 26 inches in height renders the compartment access opening 28 convenient for both adults and children to view the contents of the food storage compartment and to reach through the compartment access opening to remove items contained within the compartment. This is particularly important where the merchandiser stores food items that are particularly attractive to children. Examples of such items would be ice cream, frozen popsicles, and the like.

As shown in FIG. 1 for example, the preferred embodiment of the present invention preferably includes a housing 38 that is heat insulated from the refrigerated compartment. Housing 38 can be disposed at one end of the merchandiser or can be disposed at any point intermediate the two ends of the merchandiser, as required by the customer. As shown in FIG. 1 for example, housing 38 defines a top panel 42, a rear panel 44, two opposed side panels, 46, 48 (shown in FIG. 2 but not in FIG. 1), and a front opening 50. Housing 38 does not have a bottom panel, and floor level 34 can be seen in the view shown in FIG. 1.

As shown in FIGS. 1 and 2 for example, a mounting board 52 is configured, disposed and mounted to slide through front opening 50 of housing 38. Mounting board 52 can be engaged to slide on tracks 54 or any other conventional means for slidably mounting board 52 so as to enable it to move into and out of housing 38. Thus, components mounted on mounting board 52 can be selectively disposed either inside or outside housing 38 by moving board 52 into or out of, respectively, housing 38. This facilitates access to components mounted on board 52 for purposes of repair or replacement of such components.

In further accordance with the present invention, a cabinet 56 is provided for enclosing housing 38 and compartment 11 therewithin. Cabinet 56 forms the outer covering that is aesthetically pleasing to the viewing customer and encloses all the working components of the merchandiser therewithin.

Preferably, the major mechanical components of the refrigerating mechanism are mounted on mounting board 52. A compressor 58 is preferably mounted at the end of mounting board 52 which is disposed toward rear panel 44 of housing 38 when mounting board 52 is disposed completely within housing 38. A sealed motor compressor suitable for commercial refrigeration such as a COPELEMATIC brand K-Line motor compressor is preferred. It is available from Copeland Corporation of Sidney, Ohio 45365. A conventional bare-tube condenser unit 60 also preferably is mounted on mounting board 52. Condenser 60 preferably is mounted closest to the end of mounting board 52 that is closest to front opening 50 of housing 38. A conventional condensate tray 68 also can be carried lengthwise on mounting board 52 alongside condenser 60 and compressor 58.

In further accordance with the present invention, means are provided for moving air across the condenser and the compressor and out of the housing. As embodied herein and shown in FIGS. 1 and 2 by way of example, the means for moving air across the condenser and the compressor and out of the housing preferably includes a fan 64, which is disposed preferably between condenser 60 and compressor 58 and driven by a motor 62. The blades of fan 64 are configured so that rotation of same by motor 62 forces air against and through the tubes of condenser 60 and draws air across compressor 58. Preferably, as shown in FIG. 1 for example, motor driven fan 64 is disposed within an enclosure 66 that is common to and covers both condenser 60 and fan 64. Alternative dispositions of fan 64 can be made. However, the main requirement is that the fan be disposed so as to move air across condenser 60 and compressor 58 and through front opening 50 of housing 38.

Figure 4:
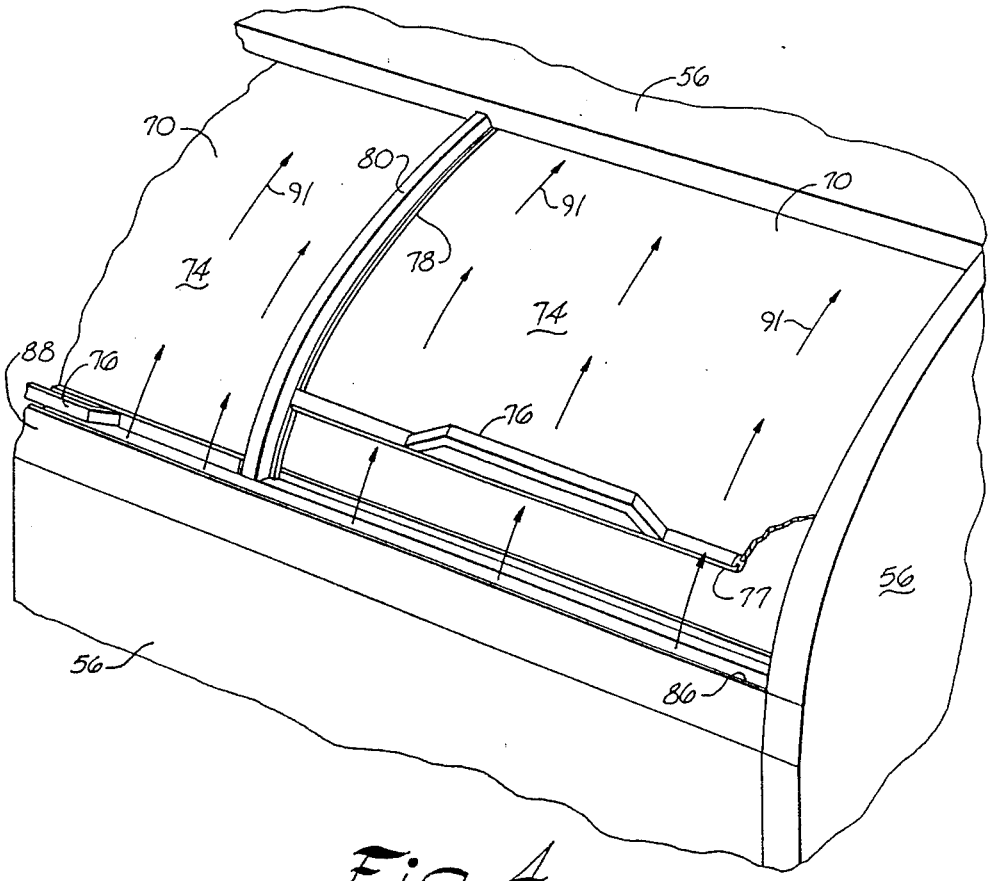
FIG. 4 illustrates a partial top perspective view of the sliding curved lids with the air flow indicated by arrows covering the outer surface of the lids.

In further accordance with the present invention, means are provided for allowing selective access to the compartment. As embodied herein and shown in FIG. 4 by way of example, the means for allowing selective access to the compartment includes at least one, single pane, curved glass lid 70. As shown in FIG. 4 for example, each lid has a single pane 74 of preferably tempered glass which preferably has a radius of curvature of 24.125 inches. Each lid 70 also has a handle 76 mounted at one end of lid 70, preferably the front end as shown in FIGS. 1 and 4.

In further accordance with the present invention, the means for allowing selective access to the compartment further preferably includes an H-shaped extrusion. As embodied herein and shown in FIG. 4 for example, handle 76 preferably is mounted to an H-shaped dual durometer extrusion 77, which is attached to the front edge of pane 74. One advantage of extrusion 77 is avoiding the need to drill through pane 74 in order to mount handle 76.

In further accordance with the present invention, the means for allowing selective access to the compartment further preferably includes a T-shaped extrusion attached to the back edge of each lid. As shown in FIG. 2 for example, a T-shaped dual durometer extrusion 79 preferably is attached to the back edge of pane 74 of each lid 70.

The two dual durometers 77, 79 preferably are formed of a plastic material such as polyvinylchloride (PVC). The portions of each extrusion engaging pane 74 are more rigid than the oppositely disposed ends which are more elastomeric and act as seals to guard against the passage of air past the front and back of each lid 70 when lid 70 is closed. As shown in FIG. 2 for example, front extrusion 77 seals against and engages a ridge 75 formed on an extrusion 73 disposed between dividing wall 84 and front wall 20. Back extrusion 79 seals against the overhanging trim 81 (FIG. 2) on cabinent 56 and against the forward, upper surface above top wall 14.

As shown in FIG. 2 for example, the means for allowing selective access to the compartment further preferably includes at least two tracks for slidably receiving the side edges of glass pane 74 of each lid 70. Tracks 78 are disposed across compartment access opening 28 and between compartment top wall 14 and cabinet 56. Thus, each lid 70 slides from the free edge 30 of front wall 20 toward rear wall 12 to open and permit access to compartment 11 through compartment access opening 28.

Preferably, each lid is spring loaded for purposes of counterbalancing same to minimize the customer effort needed to raise and lower the lid. As shown in FIG. 1 for example, each lid has two ends of a spring 72 anchored at the rear of the cabinet. The middle portion of spring 72 is preferably secured to the middle portion of the rearwardly facing back extrusion 79. In the closed position, handle 76 rests near free edge 30 of front wall 20. Preferably, a plurality of lids is used to cover the full extent of compartment access opening 28. As shown in FIG. 1 for example, three lids 70 are used, and the middle positioned lid 70 has its curved tracks disposed between a common strip of curved trim 80 with one of the curved tracks of the two lids near the ends of the merchandiser 10. The number and size of the lids is of course dependent upon the dimensions of the merchandiser.

In further accordance with the present invention, means are provided for transferring warmed air from the housing onto the selective access means to continuously defog the selective access means. As embodied herein and shown in FIGS. 1 and 2 by way of example, the means for transferring warmed air from the housing onto the selective access means to continuously defog the selective access means preferably includes an elongated channel 82, which is disposed in front of compartment front wall 20 and defined between front wall 20 and cabinet wall 56. Preferably, a dividing wall 84 is disposed between compartment front wall 20 and cabinet 56 to cooperate with cabinet 56 to define channel 82 therebetween. Channel 82 preferably extends substantially the full length of the extent of the curved glass lids along the front of merchandiser 10. Channel 82 communicates with housing 38 via front opening 50 to receive warmed air flow (arrows 91) exiting through front opening 50 of housing 38. Channel 82 has an exit slot 86 defined by a front edge member 88 and a rear edge member 89 having a free edge 90 disposed above free edge 30 of compartment front wall 20. Preferably, as shown for example in FIG. 2, free edge 90 of front edge member 88 is disposed at a vertical height (indicated by the line designated 36) of less than 26 inches above the floor level (indicated in FIG. 2 by the horizontal line designated 34) on which merchandiser 10 rests. In this way, child patrons especially are permitted easy access for viewing purposes and for removing food items from within the refrigerated compartment of merchandiser 10. Preferably, front edge member 88 extends along substantially the full length of the extent of the curved glass lids along the front of the merchandiser. Front edge member 88 also preferably is configured and disposed to direct warmed air flow 91 exiting slot 86 so that the air attaches to the exterior surface of each curved glass lid when each lid is in the position that encloses its respective compartment access opening 28.

In a preferred embodiment of the present invention, a shelf 92 is mounted against rear wall 12 of the refrigerated compartment. Shelf 92 extends outwardly in a horizontal direction from rear wall 12 and is disposed closer to top wall 14 than to lower bottom wall 22.

In further accordance with the present invention, an evaporator 94 is disposed against compartment rear wall 12. Preferably, evaporator 94 is a conventional fin-and-tube evaporator unit that extends across substantially the full length of said compartment rear wall in an upper portion thereof close to compartment top wall 14. This facilitates the convection distribution of the cooled air (arrows in compartment 11 shown in FIG. 2) that forms around evaporator 94 as it uses the heated air rising to the upper portion of refrigerated compartment 11 to evaporate the coolant carried by tubes 96 running through the length of evaporator 94. One edge of evaporator fins 98 rests about one fourth inch away from metal compartment rear wall 12 and transfers heat by convection as known in the art. Another edge of fins 98 rests about one quarter inch away from shelf 92, which also preferably is constructed of metal. Shelf 92 defines a drain pan for evaporator 94 and catches condensate which is piped (not shown) away to condensate tray 68 in the conventional manner known in the art.

In some preferred embodiments as shown in FIG. 2 for example, a fluorescent light tube 99 runs the length of compartment 11 disposed from top wall 14 at a height above the height of evaporator 94 and between evaporator 94 and a reflecting light strip 101.

In further accordance with the present invention, the coolant is carried between the evaporator and the compressor by at least one conduit. As embodied herein and shown for example in FIG. 5, a refrigerant conduit 100 carries refrigerant between condenser 60 around the walls of compartment 11, to tubes 96 of evaporator 94 and back to compressor 58, the direction of flow of the refrigerant being indicated by arrows 102 and 104. The dashed lines in FIG. 5 define the edges of various walls of compartment 11. The refrigerant can be any of the conventional chlorofluorocarbons or any of the substitute refrigerants being developed to replace chlorofluorocarbons for environmental protection reasons.

Figure 5:
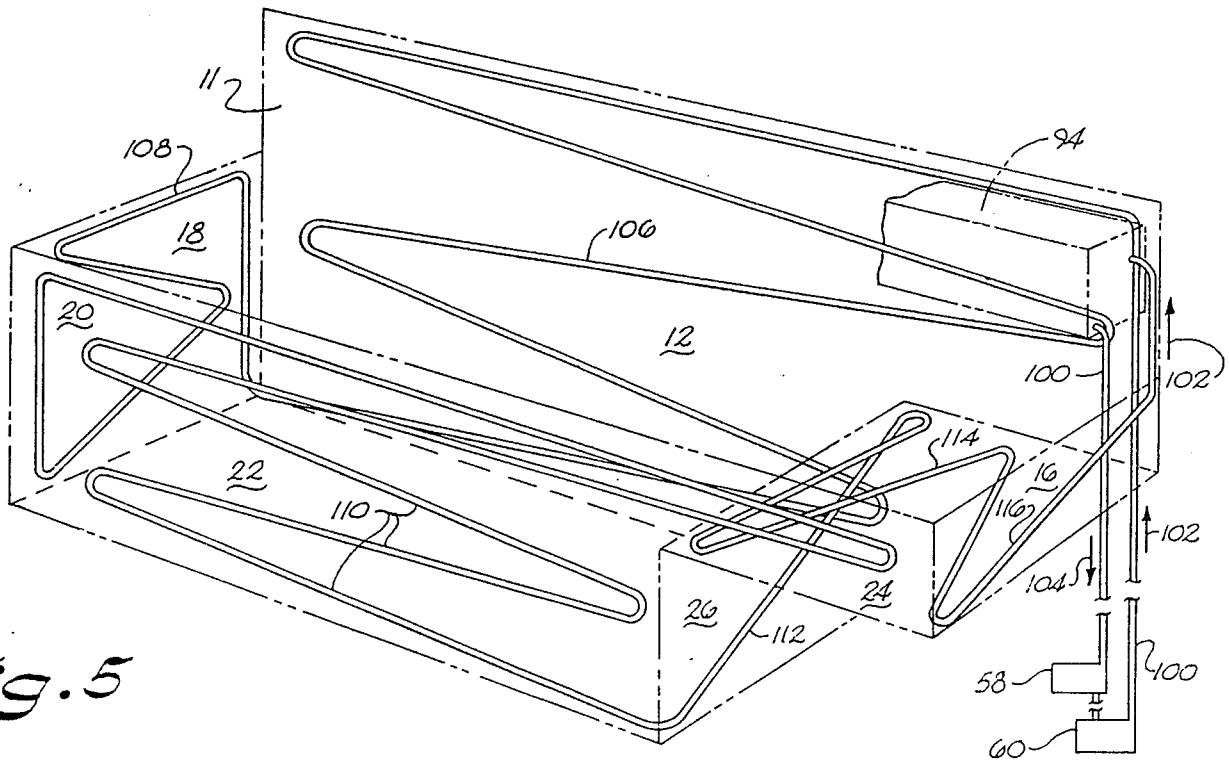
FIG. 5 illustrates an example of the disposition of the various lengths of the conduit carrying the coolant between the condenser and the fin-and-tube evaporator and resting against th exterior surfaces of the walls of the refrigerated compartment.

As shown in FIG. 5 for example, refrigerant conduit 100 preferably has one or more lengths which are integrally formed but can be joined by conventional joints and connections. A first length 106 is preferably disposed against compartment rear wall 12. A second length 108 is preferably disposed against the larger compartment end wall 18. A third length of refrigerant conduit 100 is preferably disposed against compartment front wall 20. A fourth length 112 of refrigerant conduit 100 preferably is disposed against interior compartment side wall 26. A fifth length 114 of refrigerant conduit 100 preferably is disposed against upper bottom compartment wall 24. A sixth length 116 of refrigerant conduit 100 preferably is disposed against the smaller compartment end wall 16 and connects to the inlet of evaporator 94. Refrigerant conduit 100 preferably is formed of copper tubing and preferably rests against the exterior surfaces of the walls of the refrigerated compartment and is attached thereto in a conventional manner such as by means of foil tape. Thus, the various lengths 106, 108, 110, 112, 114, and 116, of refrigerant conduit 100 do not detract from the available volume of space within the refrigerated compartment. Refrigerant conduit 100 also functions as a cold wall evaporator and assists the cooling process by conduction heat transfer in cooperation with the metallic walls of the refrigerated compartment.

As shown in FIG. 5 for example, preferably the coolant carried by refrigerant conduit 100 enters refrigerant conduit 100 from condenser 60 and travels completely around the full length of refrigerant conduit 100 through all of the various lengths thereof before entering the inlet of evaporator 94 and being connected to tubes 96 of evaporator 94. The coolant exits the tubes of evaporator 94 and moves in the direction indicated by arrow 104 into compressor 58.

In further accordance with the present invention, heat insulation is disposed surrounding the compartment walls to shield them from unwanted transfer of heat into the refrigerated compartment. As embodied herein and shown in FIGS. 1 and 2 for example, heat insulation such as foam insulation 118 is blown into the space between the exterior surface of the compartment walls and cabinet 56. The foam insulation expands to rigidly separate the refrigerated compartment walls and the cabinet and to hold refrigerant conduit tubing 100 permanently in contact with the refrigerated compartment walls. In addition, heat insulation 118 also is disposed between the external surface of interior compartment side wall 26 and the exterior surface of side panel 48 of housing 38. Again, the foam insulation expands to rigidly separate interior compartment side wall 26 and side panel 48 of housing 38 and to hold refrigerant conduit tubing 100 permanently in contact with interior compartment side wall 26. Heat insulation 118 also is disposed between top panel 42 of housing 38 and the exterior surface of upper bottom compartment wall 24. The foam insulation expands to rigidly separate top panel 42 of housing 38 and upper bottom compartment wall 24 and to hold refrigerant conduit tubing 100 permanently in contact with upper bottom compartment wall 24. Moreover, heat insulation further is disposed between the interior surface of dividing wall 84 and the exterior surface of compartment front wall 20 so as to insulate the refrigerated compartment from the warmed air circulating up through channel 82. The foam insulation expands to rigidly separate dividing wall 84 and compartment front wall 20 and to hold refrigerant conduit tubing 100 permanently in contact with compartment front wall 20. Heat insulation 118 also serves to insulate the various lengths of refrigerant conduit 100 from transfer of heat to same other than through the walls of compartment 11.

The frozen food merchandiser of the present invention combines numerous advantageous features in a single design. Some, but not all, of the advantages are discussed below and elsewhere in this application. Mounting board 52 provides convenient access to the mechanical components for maintenance and repair of same on site. Evaporator 94 is advantageously disposed in the upper rear portion of the refrigerated compartment with its fins about one fourth inch away from the metallic rear wall and shelf to take full advantage of heat convection. The refrigerant conduit tubing is kept out of the interior of the refrigerated space to maximize same and wrapped around the various walls of the refrigerated compartment to perform useful heat transfer functions. The insulation performs the three functions of insulating the refrigerant conduit tube 100 and compartment 11 from heat transfer, helping to secure the refrigerant conduit 100 in place against the exterior of the compartment walls, and maintaining a rigid separation between the compartment walls and various other structures such as housing panels 42 and 48, cabinet 56, and divider wall 84. The single pane glass lids are counterbalanced by spring mountings conventionally known in the art. The front and back edges of each glass pane 74 are respectively attached to H-shaped and T-shaped plastic extrusions 77, 79 which prevent air from getting past the front and back of the lids when closed. The front extrusion 77 provides a convenient surface for mounting lid handle 76. The height at which the customer first gains access to the compartment access opening of the refrigerated compartment is especially close to the floor on which the merchandiser rests to accommodate viewing and reach-in access by shorter patrons such as children. Channel 82 is provided to direct warm air to aerodynamically attach to the outer surface of lids 70 so as to prevent or remove condensation which may tend to form thereon. Fan 64 is advantageously disposed so as to draw air over compressor 58 and through condenser 60 and housing opening 50 to gain entry into channel 82 on its way toward supplying the warm air that is directed onto lids 70. A fluorescent light tube 99 runs the length of compartment 11 disposed from top wall 14 at a height above the height of evaporator 94 and between evaporator 94 and a reflecting light strip 101. The fluorescent light minimizes energy consumption and heat introduced into compartment 11. Reflecting strip 101 improves energy efficiency by directing the light toward the compartment's bottom walls which support the items to be viewed by the customer.

What is claimed is:

1. A frozen food merchandiser, comprising:

(a) a compartment for holding items to be frozen;

(b) means for allowing selective access to said compartment, said means for allowing selective access to said compartment including at least one, single pane, curved glass lid;

(c) a housing which is heat insulated from said compartment;

(d) a cabinet for enclosing said housing and said compartment therewithin;

(e) a compressor mounted for selective disposition into and out of said housing;

(f) a condenser mounted for selective disposition into and out of said housing;

(g) means for moving air across said condenser and said compressor and out of said housing;

(h) means for transferring warmed air from said housing onto said selective access means to continuously defog said selective access means;

(i) an evaporator disposed inside said compartment;

(j) at least one conduit for carrying refrigerant between said evaporator and said compressor and being disposed against the exterior surface of said compartment; and (k) heat insulation disposed around the exterior surfaces of said compartment.

2. An apparatus as in claim 1, wherein:

said means for transferring warmed air from said housing onto said selective access means to continuously defog said selective access means includes an elongated channel disposed in front of said compartment and between said compartment and said cabinet, said channel extending substantially the full length of the extent of said selective access means along the front of the merchandiser and communicating with said housing to receive warmed air from said housing, said channel having an exit slot defined by a front edge member having a free edge disposed at a vertical height of less than 26 inches above the floor on which the merchandiser rests, said free edge being configured and disposed to direct air exiting said slot to attach to the exterior surface of said selective access means.

3. An apparatus as in claim 2, wherein:

said compartment including an interior side wall and an upper bottom wall connected at one edge to said interior side wall;

said housing including two opposed side panels and a top panel connecting said side panels; and said heat insulation being disposed between said cabinet and said compartment, between said cabinet and said housing, between said at least one interior side wall and at least one of said side panels, between said top panel and said upper bottom wall, and between said compartment and said channel.

4. An apparatus as in claim 1, wherein:

said housing defining a front opening; and said means for moving air across said condenser and said compressor and out of said housing includes a fan disposed so as to move air across said condenser and said compressor and through said front opening of said housing.

5. An apparatus as in claim 4, wherein:

said condenser is disposed closer to said front opening of said housing than said compressor when said condenser and compressor are both disposed within said housing.

6. A frozen food merchandiser comprising:

(a) a compartment for holding items to be frozen, said compartment having a top wall and at least one opening permitting access to said compartment;

(b) means for allowing selective access to said compartment, said means for allowing selective access to said compartment including at least one, single pane, curved glass lid;

(c) a housing which is heat insulated from said compartment;

(d) a cabinet for enclosing said housing and said compartment therewithin;

(e) a compressor mounted for selective disposition into and out of said housing;

(f) a condenser mounted for selective disposition into and out of said housing;

(g) means for moving air across said consenser and said compressor and out of said housing;

(h) means for transferring warmed air from said housing onto said selective access means to continuously defog said selective access means;

(i) an evaporator disposed inside said compartment;

(j) at least one conduit for carrying refrigerant between said evaporator and said compressor and being disposed against the exterior surface of said compartment; and (k) heat insulation disposed around the exterior surfaces of said compartment.

7. An apparatus as in claim 6, wherein:

said means for allowing selective access to said compartment including at least two curved tracks for slidably receiving the side edges of each said lid, said tracks being disposed across said compartment opening and between said compartment top wall and said cabinet.

8. An apparatus as in claim 6, wherein:

said means for allowing selective access to said compartment including an H-shaped extrusion attached to the front edge of at least said one lid.

9. An apparatus as in claim 6, wherein:

said means for allowing selective access to said compartment including an extrusion attached to the front edge of at least said one lid and a handle mounted against said extrusion.

10. An apparatus as in claim 6, wherein:
said means for allowing selective access to said compartment including a T-shaped extrusion attached to the back edge of at least said one lid.

11. An apparatus as in claim 6, wherein:
said housing including a front opening;
said compartment including a front wall; and
said means for transferring warmed air from said housing onto said selective access means to continuously defog said selective access means includes an elongated channel disposed in front of said compartment front wall and between said front wall and said cabinet, said channel extending substantially the full length of the extent of the curved glass lids along the front of the merchandiser and communicating with said housing via said front opening to receive warmed air exiting through said front opening of said housing, said channel having an exit slot defined by a front edge member having a free edge disposed at a vertical height of less than 26 inches above the floor on which the merchandiser rests, said free edge being configured and disposed to direct air exiting said slot to attach to the exterior surface of each said curved glass lid.

12. An apparatus as in claim 1, wherein:
said compartment defining a rear wall, a top wall, a pair of end walls, a front wall, a lower bottom wall, an upper bottom wall disposed closer to said top wall than to said lower bottom wall, at least one interior side wall connecting one end of said lower bottom wall to one end of said upper bottom wall, and at least one compartment access opening, at least one said opening being defined at least in part by a free edge of said front wall and a free edge of said top wall; and
said conduit has a first length thereof disposed against said rear wall of said compartment, a second length disposed against said one of said end walls, a third length disposed against said front wall, a fourth length disposed against said one interior side wall, a fifth length disposed against said upper bottom wall, and a sixth length disposed against said other of said end walls.

13. A frozen food merchandiser, comprising:
(a) a compartment for holding items to be frozen, said compartment defining a rear wall, a top wall, a pair of end walls, a front wall, a lower bottom wall, an upper bottom wall disposed closer to said top wall than said lower bottom wall, at least one interior side wall connecting one end of said lower bottom wall to one end of said upper bottom wall, and at least one compartment access opening, each said opening being defined at least in part by a free edge of said front wall and a free edge of said top wall, said free edge of said front wall being disposed at a height no greater than 26 inches above the floor on which the merchandiser rests;
(b) a housing defining a top panel, a rear panel, two opposed side panels, and a front opening;
(c) a mounting board disposed to slide through said front opening of said housing;
(d) a cabinet for enclosing said housing and said compartment therewithin;
(e) a compressor mounted on said mounting board;
(f) a condenser mounted on said mounting board and disposed closer to said front opening of said housing than said compressor;
(g) a fan disposed so as to move air across said condenser and said compressor and through said front opening of said housing;
(h) at least one, single pane, cylindrically curved glass lid;
(i) at least two curved tracks for slidably receiving the side edges of each said lid, said tracks being disposed across said compartment opening and between said compartment top wall and said cabinet;
(j) an elongated channel disposed in front of said compartment front wall and between said front wall and said cabinet, said channel extending substantially the full length of the front of the merchandiser and having one end thereof ccmmunicating with said housing via said front opening to receive warmed air exiting through said front opening of said housing, said channel having an exit slot defined by a front edge member and a rear edge member, said front edge member extending substantially the full length of the extent of the curved glass lids along the front of the merchandiser and being configured and disposed to direct air exiting said slot to attach to the exterior surface of each curved glass lid when each said lid extends above and across each said compartment opening;
(k) an evaporator disposed against and extending across substantially the full length of said rear wall of said compartment;
(l) at least one conduit for carrying refrigerant between said evaporator and said compressor and having a first length thereof disposed against said rear wall of said compartment, a second length disposed against said one of said end walls, a third length disposed against said front wall, a fourth length disposed against said one interior side wall, a fifth length disposed against said upper bottom wall, and a sixth length disposed against said other of said end walls; and
(m) heat insulation disposed between said cabinet and each of said compartment and housing, between said at least one interior side wall and at least one of said side panels, between said top panel and said upper bottom wall, and between said compartment and said channel.

14. An apparatus as in claim 13, further comprising:
(n) an H-shaped extrusion attached to the front edge of at least said one lid.

15. An apparatus as in claim 14, further comprising:
(o) a handle mounted against said said extrusion.

16. An apparatus as in claim 13, further comprising:
(p) a T-shaped extrusion attached to the back edge of at least said one lid.

17. An apparatus as in claim 13, wherein:
said evaporator has a plurality of fins disposed near yet away from contact with said rear wall of said compartment.

18. A frozen food merchandiser, comprising:
(a) a compartment for holding items to be frozen, said compartment defining a rear wall, a top wall, a pair of end walls, a front wall, a lower bottom wall, an upper bottom wall disposed closer to said top wall than said lower bottom wall, at least one interior side wall connecting one end of said lower bottom wall to one end of said upper bottom wall, and at least one compartment access opening, each said opening being defined at least in part by a free edge of said front wall and a free edge of said top wall;

(b) a housing defining a top panel, a rear panel, two opposed side panels, and a front opening;
(c) a mounting board disposed to slide through said front opening of said housing;
(d) a cabinet for enclosing said housing and said compartment therewithin;
(e) a compressor mounted on said mounting board;
(f) a condenser mounted on said mounting board and disposed closer to said front opening of said housing than said compressor;
(g) a fan disposed so as to move air across said condenser and said compressor and through said front opening of said housing;
(h) at least one, single pane, curved glass lid;
(i) at least two curved tracks for slidably receiving the side edges of each said lid, said tracks being disposed across said compartment opening and between said compartment top wall and said cabinet;
(j) an elongated channel disposed in front of said compartment front wall and between said front wall and said cabinet, said channel extending substantially the full length of the extent of the curved glass lids along the front of the merchandiser and communicating with said housing via said front opening to receive warmed air exiting through said front opening of said housing, said channel having an exit slot defined by a front edge member having a free edge disposed above said free edge of said compartment front wall and at a vertical height of less than 26 inches above the floor on which the merchandiser rests, said front edge member extending along substantially the full length of the extent of the curved glass lids along the front of the merchandiser and being configured and disposed to direct air exiting said slot to attach to the exterior surface of each curved glass lid when each said lid encloses each said compartment opening;
(k) a shelf extending from said rear wall of said compartment and disposed closer to said top wall than said bottom wall;
(l) an evaporator disposed above said shelf and extending across substantially the full length of said compartment and mounted against said rear wall;
(m) at least one conduit for carrying refrigerant between said evaporator and said compressor and having a first length thereof disposed against said rear wall of said compartment, a second length disposed against said one of said end walls, a third length disposed against said front wall, a fourth length disposed against said one interior side wall, a fifth length disposed against said upper bottom wall, and a sixth length disposed against said other of said end walls; and
(n) heat insulation disposed between said cabinet and each of said compartment and housing, between said at least one interior side wall and at least one of said side panels, between said top panel and said upper bottom wall, and between said compartment and said channel.

19. An apparatus as in claim 18, further comprising:
(o) an H-shaped extrusion attached to the front edge of at least said one lid; and
(p) a T-shaped extrusion attached to the back edge of at least said one lid.

20. An apparatus as in claim 18, further comprising:
(o) an extrusion attached to the front edge of at least said one lid and a handle mounted against said extrusion.

* * * * *